US008327995B1

(12) United States Patent
Folk et al.

(10) Patent No.: US 8,327,995 B1
(45) Date of Patent: Dec. 11, 2012

(54) CASH HANDLING DEVICE HAVING ENVIRONMENTAL CONDITION MONITORING SYSTEM

(75) Inventors: Amy Baker Folk, Charlotte, NC (US); Daniel Christopher Bohen, Charlotte, NC (US)

(73) Assignee: Bank of America Corporation, Charlotte, NC (US)

( * ) Notice: Subject to any disclaimer, the term of this patent is extended or adjusted under 35 U.S.C. 154(b) by 128 days.

(21) Appl. No.: 12/893,022

(22) Filed: Sep. 29, 2010

Related U.S. Application Data

(63) Continuation of application No. 12/277,865, filed on Nov. 25, 2008, now Pat. No. 8,157,078.

(51) Int. Cl.
*G07C 3/00* (2006.01)
*G07F 7/04* (2006.01)
*G07F 9/02* (2006.01)

(52) U.S. Cl. ..... 194/206; 194/200

(58) Field of Classification Search ..... 194/206, 194/200; 209/534; 235/376, 379; 312/236; 359/507; 356/240.1; 399/8, 9, 44, 98; 700/275
See application file for complete search history.

(56) References Cited

U.S. PATENT DOCUMENTS

| | | | | |
|---|---|---|---|---|
| 4,087,568 | A | 5/1978 | Fay et al. | |
| 5,021,765 | A | 6/1991 | Morgan | |
| 5,626,822 | A * | 5/1997 | Kadowaki et al. | 422/307 |
| 5,910,851 | A | 6/1999 | Flaherty | |
| 6,142,284 | A | 11/2000 | Saltsov | |
| 6,229,317 | B1 | 5/2001 | Barchuk | |
| 6,536,662 | B1 * | 3/2003 | Ohno | 235/379 |
| 6,966,485 | B2 | 11/2005 | Lute et al. | |
| 7,600,671 | B2 * | 10/2009 | Forrest et al. | 235/376 |
| 7,721,868 | B2 * | 5/2010 | Wilfer | 194/302 |
| 2004/0129773 | A1 * | 7/2004 | Lute et al. | 235/379 |
| 2008/0035446 | A1 * | 2/2008 | Yoshida et al. | 194/318 |
| 2008/0040179 | A1 | 2/2008 | Masermann | |
| 2008/0237335 | A1 | 10/2008 | Sawa | |
| 2008/0283451 | A1 * | 11/2008 | Holl et al. | 209/534 |
| 2010/0006644 | A1 | 1/2010 | Shepley et al. | |
| 2012/0013892 | A1 * | 1/2012 | Jones et al. | 356/71 |

OTHER PUBLICATIONS

Non-Final Office Action issued in corresponding Parent case U.S. Appl. No. 12/277,865 mailed Apr. 15, 2011.

* cited by examiner

*Primary Examiner* — Mark Beauchaine

(74) *Attorney, Agent, or Firm* — Banner & Witcoff, Ltd; Michael A. Springs

(57) ABSTRACT

A cash recycler or other currency handling device includes an environmental condition monitoring system including a plurality of sensors configured to monitor environmental conditions inside the housing of the cash recycler. In some arrangements, the temperature and/or humidity within the housing will be monitored. Upon sensing that the conditions are outside of a predetermined threshold, an indication will be sent to a controller that will adjust operation of the cash recycler based on the indications received from the sensors.

17 Claims, 10 Drawing Sheets

CASH HANDLING DEVICE HAVING ENVIRONMENTAL CONDITION MONITORING SYSTEM

RELATED APPLICATION

This application is a continuation of pending U.S. patent application Ser. No. 12/277,865 filed Nov. 25, 2008, entitled "Cash Handling Device Having Environmental Condition Monitoring System", which application is herein incorporated by reference in its entirety.

BACKGROUND

Cash flow refers to the movement of cash over a particular time period within a business or enterprise. The calculation of cash flow may be used as one measure to gauge financial health of the business. Managers in charge of cash flow management may use various tools to assist in making decisions involving cash flow including cash recyclers which allow a retail establishment to maintain and re-use an amount of currency on-site. The cash recycler may further calculate and manage use of cash flows in real-time.

Cash recyclers are typically set up in a "one size fits all" type of arrangement where ambient conditions, environmental conditions within the housing of the cash recycler, and the like are not taken into account when determining operating parameters of the cash recycler. Accordingly, environmental conditions, such as high temperature, high humidity, and the like, can cause paper jams, malfunctions or other issues requiring service because of the impact the high temperature and/or humidity has on the currency within the machine or even components of the machine. Severe shifts between high and low temperatures and/or high and low humidity levels may exacerbate the problem. Accordingly, there is a need for an environmental condition monitoring system to monitor the conditions within the cash recycler and adjust operation of the cash recycler based on those conditions.

SUMMARY

The following presents a simplified summary in order to provide a basic understanding of some aspects of the invention. The summary is not an extensive overview of the invention. It is neither intended to identify key or critical elements of the invention nor to delineate the scope of the invention. The following summary merely presents some concepts of the invention in a simplified form as a prelude to the description below.

Aspects of this invention relate to an environmental condition monitoring system for a cash handling device, such as a cash recycler. The environmental condition monitoring system includes one or more sensors for sensing temperature, humidity, and the like within a housing of the cash recycler. Indications of the conditions within the housing are transmitted from the sensor to a controller of the cash recycler. In response to an indication that that a condition is outside of specified threshold operating levels, the controller will adjust operation of the cash recycler to optimize performance and/or prevent malfunction, service issues, and the like.

BRIEF DESCRIPTION OF THE DRAWINGS

The present disclosure is illustrated by way of example and not limited in the accompanying figures in which like reference numerals indicate similar elements.

The reader is advised that the attached drawings are not necessarily drawn to scale.

DETAILED DESCRIPTION

Aspects of the present disclosure relate to cash handling devices. Cash handling devices generally refer to devices that are configured to accept and/or dispense currency. Cash handling devices include payment kiosks, point of sale systems such as cash registers, automated teller machines (ATMs), currency recyclers and the like. Currency recyclers generally refer to cash handling devices that are configured to dispense the same currency that was earlier deposited. For example, if a user deposits a 5 dollar bill into a cash recycler machine, the same 5 dollar bill may be dispensed during a subsequent withdrawal transaction. Thus, using currency recyclers, deposited currency may be placed immediately back into use and circulation instead of being held or frozen until a bank is able to collect and reconcile the funds, stored indefinitely and/or taken out of circulation entirely as is the case with other current cash handling devices.

Figure 1:
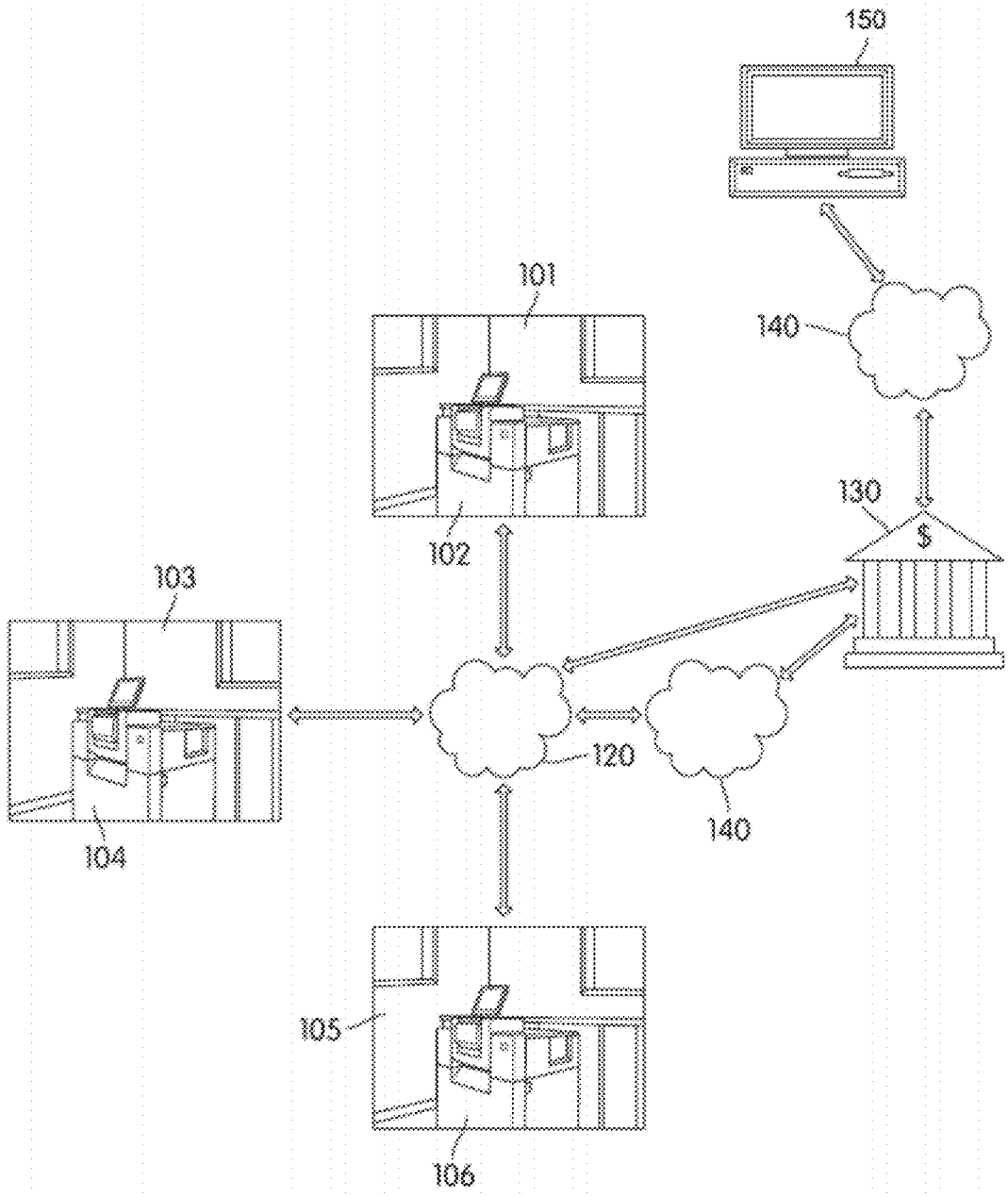
FIG. 1 illustrates an example of a suitable operating environment in which various aspects of the disclosure may be implemented.

FIG. 1 illustrates an example of a suitable operating environment in which various aspects of the disclosure may be implemented. Devices 102, 104, 106 may include currency recyclers and/or other cash handling devices and may be located at various sites such as locations 101, 103, and 105. The locations may represent different stores of a business enterprise. For example, locations 101, 103, and 105 may represent three different grocery stores located in different geographical areas belonging to a grocery store chain. Those skilled in the art will realize that additional cash handling devices may be located in the same store or in other stores belonging to the grocery store chain. In addition, those skilled in the art will realize that a grocery store chain is only one illustrative example of the types of locations or businesses that cash handling devices such as recyclers may be located. For example, cash recyclers may also be located in gas stations, post offices, department stores, and other places where cash and other financial instruments are deposited or withdrawn.

FIG. 1 further illustrates that cash handling devices 102, 104, and 106 may be connected to a communications network such as communications network 120. Communications network 120 may represent: 1) a local area network (LAN); 2) a simple point-to-point network (such as direct modem-to-modem connection); and/or 3) a wide area network (WAN), including the Internet and other commercial based network services.

Cash handling devices 102, 104, and 106 may communicate with one another or with a financial institution such as bank 130 via communication network 120 in various manners. For example, communications between cash handling devices 102, 104, 106 and bank 130 may use protocols and networks such as TCP/IP, Ethernet, FTP, HTTP, BLUETOOTH, Wi-Fi, ultra wide band (UWB), low power radio frequency (LPRF), radio frequency identification (RFID), infrared communication, IrDA, third-generation (3G) cellular data communications, Global System for Mobile communications (GSM), or other wireless communication networks or the like. Communications network 120 may be directly connected to a financial institution such as bank 130. In another embodiment, communications network 120 may be connected to a second network or series of networks 140 before being connected to bank 130. According to one or more arrangements, bank 130 may utilize an infrastructure which includes a server 150 having components such as a memory, a processor, a display, and a communication interface.

Figure 2:
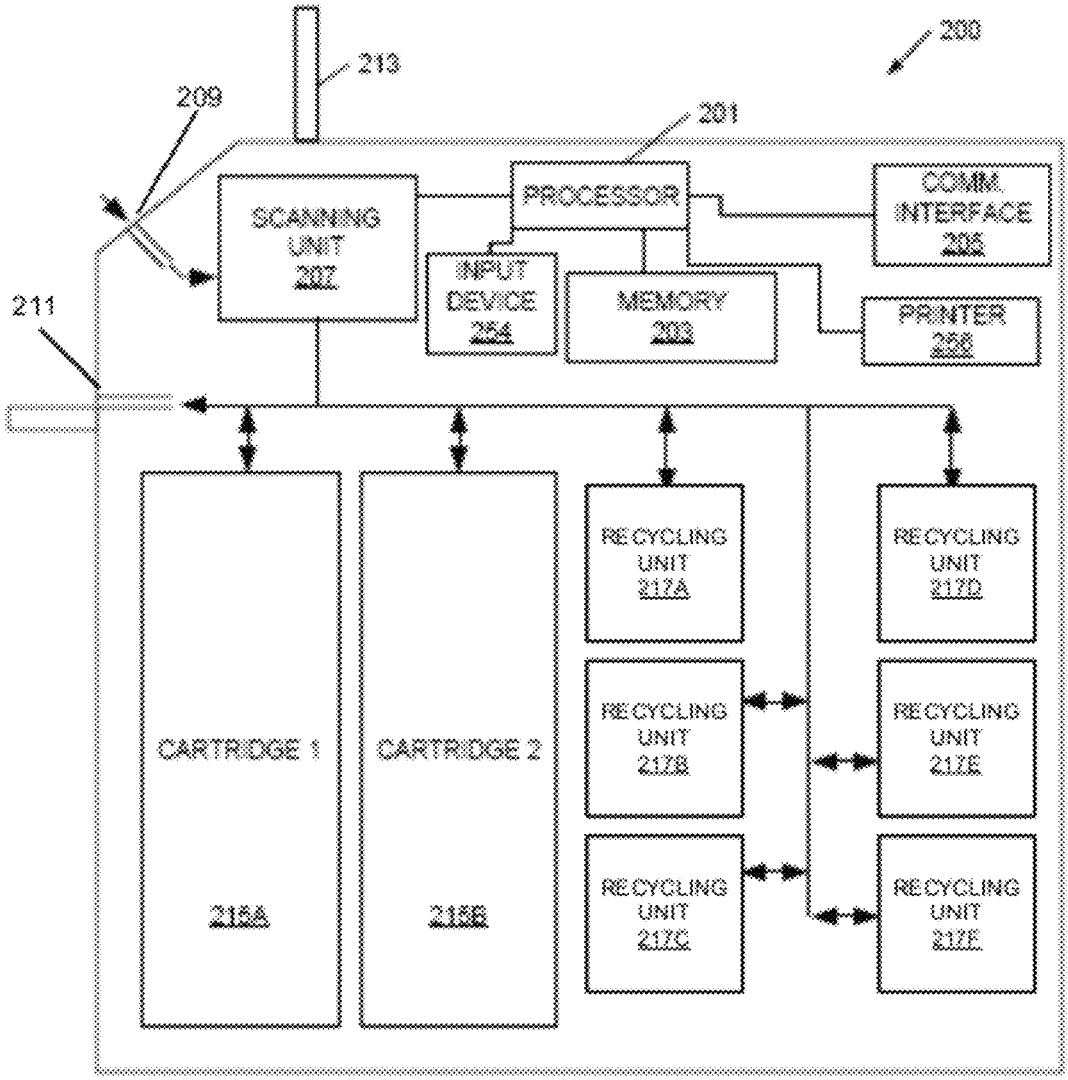
FIG. 2 illustrates a simplified diagram of a currency recycler in accordance with an aspect of the invention.

FIG. 2 illustrates a simplified diagram of a cash recycler that may be used in accordance with the operating environment of FIG. 1. Cash recycler 200 may include processor 201, memory 203, communication interface 205, scanning unit 207, display 213 and various cartridges 215 and recycling units 217. Processor 201 may be generally configured to execute computer-readable instructions stored in memory 203 such that, for example, cash recycler 200 may send and receive information to and from a bank (e.g., bank 130 of FIG. 1) using communication interface 205 and via a network (e.g., networks 120 and/or 140 of FIG. 1). Memory 203 may be configured to store a variety of information including the aforementioned computer-readable instructions, funds balance data, reconciliation data, user account information and the like. Additionally, memory 203 may include non-volatile and/or volatile memory. One or more databases may be stored in the memories 108, 112, and 116.

Cash recycler 200 may further provide display 213 to present data and/or messages to a user. For example, display 213 may be configured to display a recycler balance, a transaction interface, a current deposit count, security options, transportation options and the like. One or more input devices 254 such as a keypad, keyboard, mouse, touchscreen, fingerprint scanner, retinal scanner, proximity card reader, RFID scanner and/or writer, magnetic card reader, barcode reader, and/or combinations thereof, or any other type of input device or reader capable of inputting, reading, or scanning indicia or information, may also be included in or connected to recycler 200. One or printers 256 may also be included in or connected to recycler 200 for printing receipts and notifications as well.

In cash recycler 200, recycling units 217 and cartridges 215 are configured to store currency. Currency may be inserted through input slot 209 and withdrawn through withdrawal slot 211. Recycling units 217, including stackers, rolled storage modules, and the like, may be used to store and organize currency based on denomination. For example, all $5 bills may be stored in recycling unit 2 (i.e., recycling unit 217B) while all $20 bills may be stored in recycling unit 3 (i.e., recycling unit 217C). Cartridges 215A and 215B, on the other hand, may be used to store overflow currency and/or currency for transport. Thus, if recycling units 217 become full, additional currency that is deposited into recycler 200 may be stored in an overflow cartridge such as cartridge 215B. One of cartridges 215 may be designated as a transport cartridge that stores currency to be withdrawn from the machine and transported to the bank. Alternatively or additionally, one or more of cartridges 215 may be used as an unfit bill store for currency determined to be defective to a degree that it should be taken out of circulation. Cartridges 215 and recycling units 217 may further be removable for easier access or transport.

Scanning unit 207 may be configured to scan each bill or currency that is inserted into recycler 200. Scanning unit 207 may be configured to detect defects, unauthorized reproductions, denomination, type of currency (e.g., which country the currency originates from) and the like. Scanning unit 207 may further be configured to refuse money (either through input slot 209 or withdrawal slot 211) if it cannot be properly recognized or if the currency is deemed to be an unauthorized reproduction. Scanning unit 207 may send such data to processor 201 which may, in turn, save the data in memory 203. In addition, scanning unit 207 may be configured to scan checks or other non-currency paper items, in addition to paper currency.

Further, recycler 200 may include one or more mechanical or electromechanical systems (not shown) for automatically transferring currency between stackers 217, cartridges 215, input slot 209 and withdrawal slot 211 in recycler 200. For example, currency may automatically be withdrawn from recycling units 217 and directed into cartridge 215A for storage using a series of motorized rollers. In another example, currency stored in cartridge 215A may be withdrawn and organized and stored into recycling units 217 according to denomination. Using such systems to facilitate the automated movement of currency between storage components and other portions of recycler 200 may provide efficiency and security by alleviating some of the need to manually handle currency stored within recycler 200.

Figure 3:
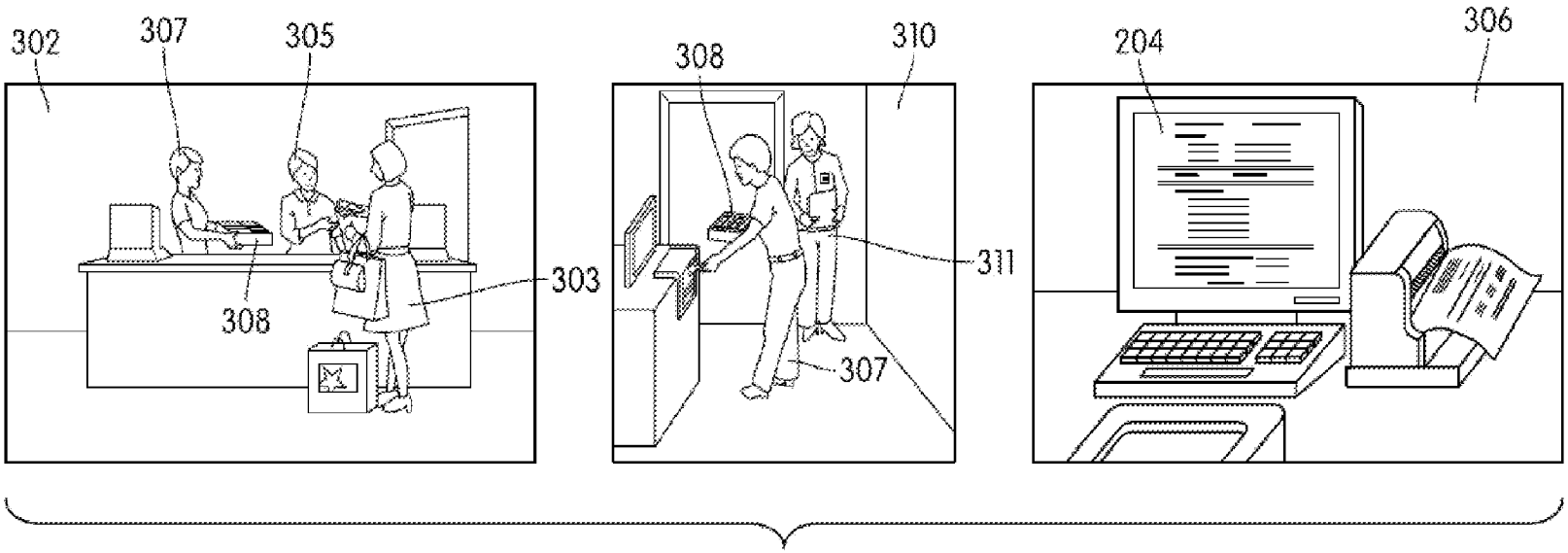
FIG. 3 illustrates various features of a currency recycler that may be used in accordance with aspects of the invention.

FIG. 3 illustrates various features of cash recycler, such as cash recycler 200 of FIG. 2, used in various aspects of the invention. The images in FIG. 3 depict use of a single cash recycler 200 in a retail environment. The retail owner may have a cash recycler 200 located in each of their stores. In an aspect of the invention, summary information for the retail owner's stores may be available via an interface to the financial institution. In another embodiment, access to summary information may be available directly from each of the cash recyclers 200.

In FIG. 3, image 302 depicts customer 303 paying cash to a retail employee such as store cashier 305 for a purchase. Another store cashier 307 at a recently closed cash register may be carrying a cash drawer or till 308 to a back office for reconciliation. In image 310, store cashier 307 may load currency from cash register till 308 into cash recycler 200. In addition, store cashier 307 may also deposit other paper forms of payment received from customer such as checks. An office manager 311 may be supervising cashier 307 during the loading of cash register till 308 into cash recycler 200. Moreover, upon the start of a shift a cashier may fill his/her cash register till with a designated amount of currency dispensed from cash recycler 200.

In image 306 of FIG. 3, a display screen (e.g., display 213 of cash recycler 200 of FIG. 2) may show the total amount entered into cash recycler 200 from till 308. The display screen 213 may breakout the amount entered into cash recycler 200 by denomination and by each cashier. The total amount deposited and withdrawn from cash recycler 200 may be shown on display screen 213.

Figure 4:
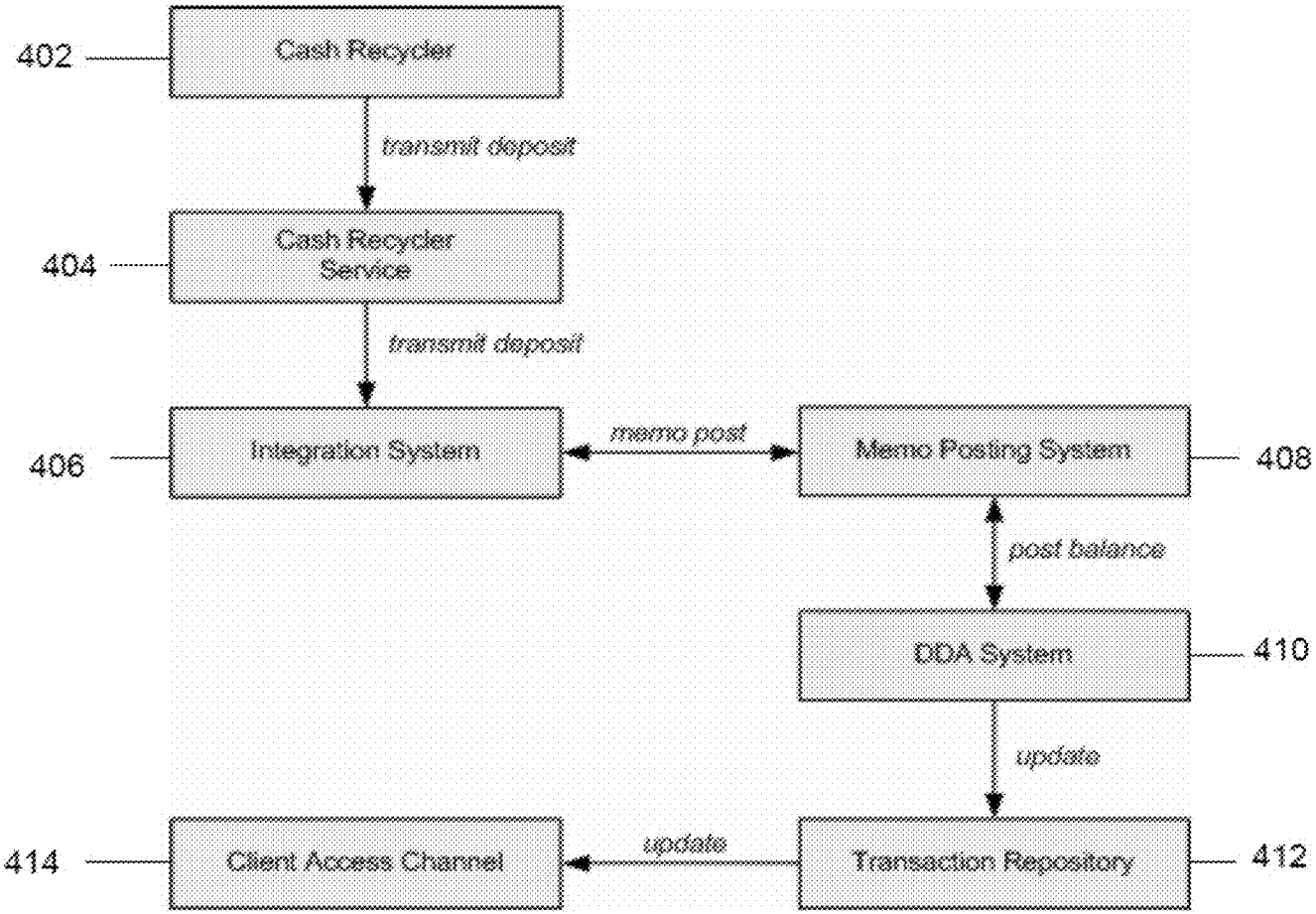
FIG. 4 illustrates a system configuration that may be used in accordance with an aspect of the invention.

FIG. 4 illustrates a system configuration that may be used in accordance with an aspect of the invention. In FIG. 4 a cash recycler 402 may communicate information to cash recycler service 404 located at a remote location. For example, cash recycler 402 may communicate deposit and withdrawal information from an enterprise location (e.g., a retail store) to the remote cash recycler service 404. The information may be routed through various networks such as the Internet to reach the cash recycler service. The cash recycler service 404 may be located in the data center of a financial institution. The cash recycler service 404 may communicate with an integration system 406 which provides access to the financial systems and processes. The integration system 406 may communicate with a memo posting system 408 which may perform posting activity. The posting system 408 may update the appropriate DDA (direct deposit account) system 410 to reflect the balance changes in the enterprises account balances. The DDA system 410 may also update a transaction repository 412 for historical and intra-day reporting purposes. An enterprise employee may access information stored in the transaction repository 412 through a client access channel 414 via web browser. Those skilled in the art will realize that the financial institution may allow the enterprise user to access the information stored in the transaction repository via numerous alternative communication methods.

According to one aspect, cash recyclers such as cash recycler 102 (FIG. 1) and 200 (FIG. 2) and other cash handling devices may facilitate real-time recognition of funds. In particular, funds deposited at a recycler or other cash handling device at a client site may be recognized by a bank at the time the deposit is made. Recognition refers to the real credit (i.e., not provisional) of deposited funds into a client's account. In contrast to current systems, there is no delay between a deposit of funds and when the funds and transaction data are submitted to the bank for recognition. Thus, instead of having to wait until the end of the day or another prescheduled time for deposits and/or withdrawals to be recognized by the bank, each deposit is processed for recognition in real-time. Data regarding the withdrawal or deposit transaction may be transmitted through a data network to the bank for recognition and processing. Providing real-time recognition offers may advantages including the ability for a client to withdraw the same currency that was earlier deposited for use in the client's operations, all at the client site and without having to first transport the deposited funds to the bank for recognition. Currency recyclers, recycling management and recognition of funds are further described in U.S. application Ser. No. 11/614,656, entitled "Commercial Currency Handling and Servicing Management," filed on Dec. 21, 2006, the content of which is incorporated herein by reference in its entirety.

Figure 5:
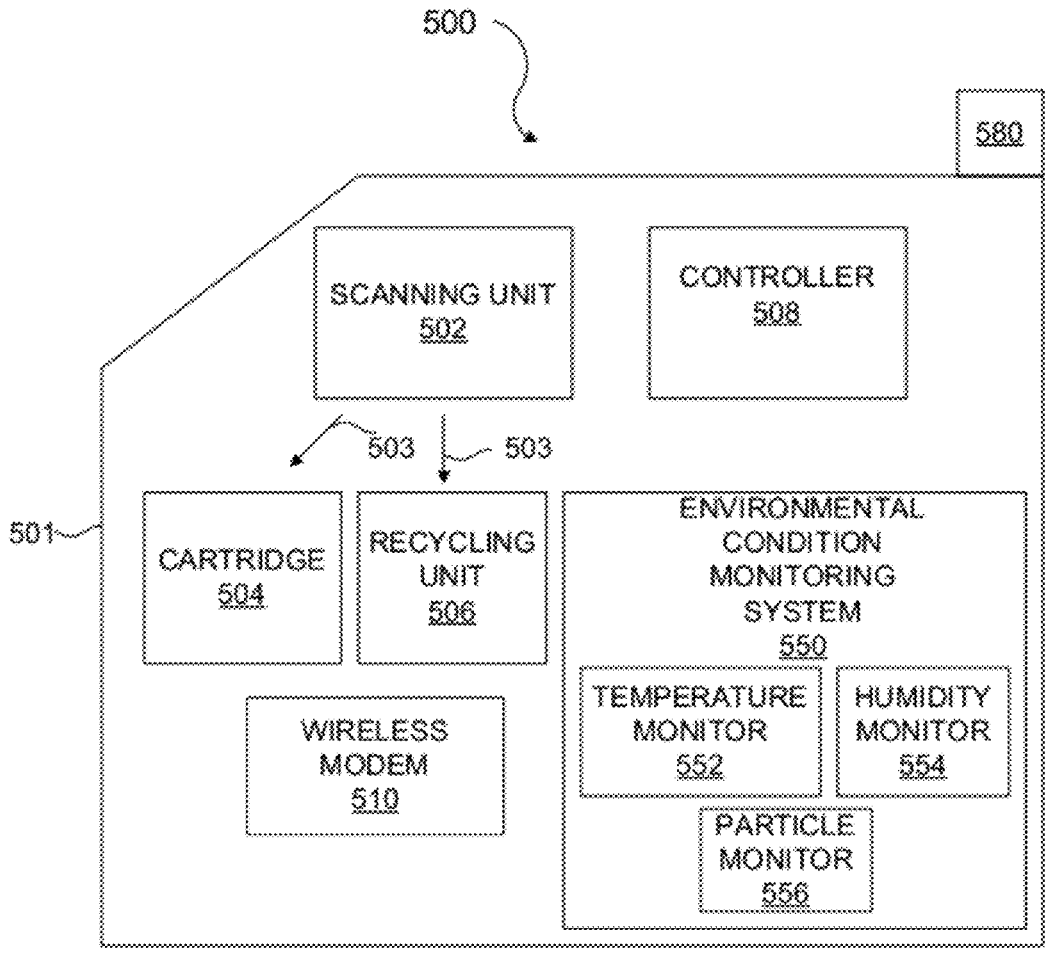
FIG. 5 is a simplified diagram of a currency recycler including various components used in accordance with one or more aspects described herein.

FIG. 5 illustrates one example cash recycler 500 having various components to simplify performance of the cash recycler 500 and improve efficiency of the cash recycler 500.

Figure 6:
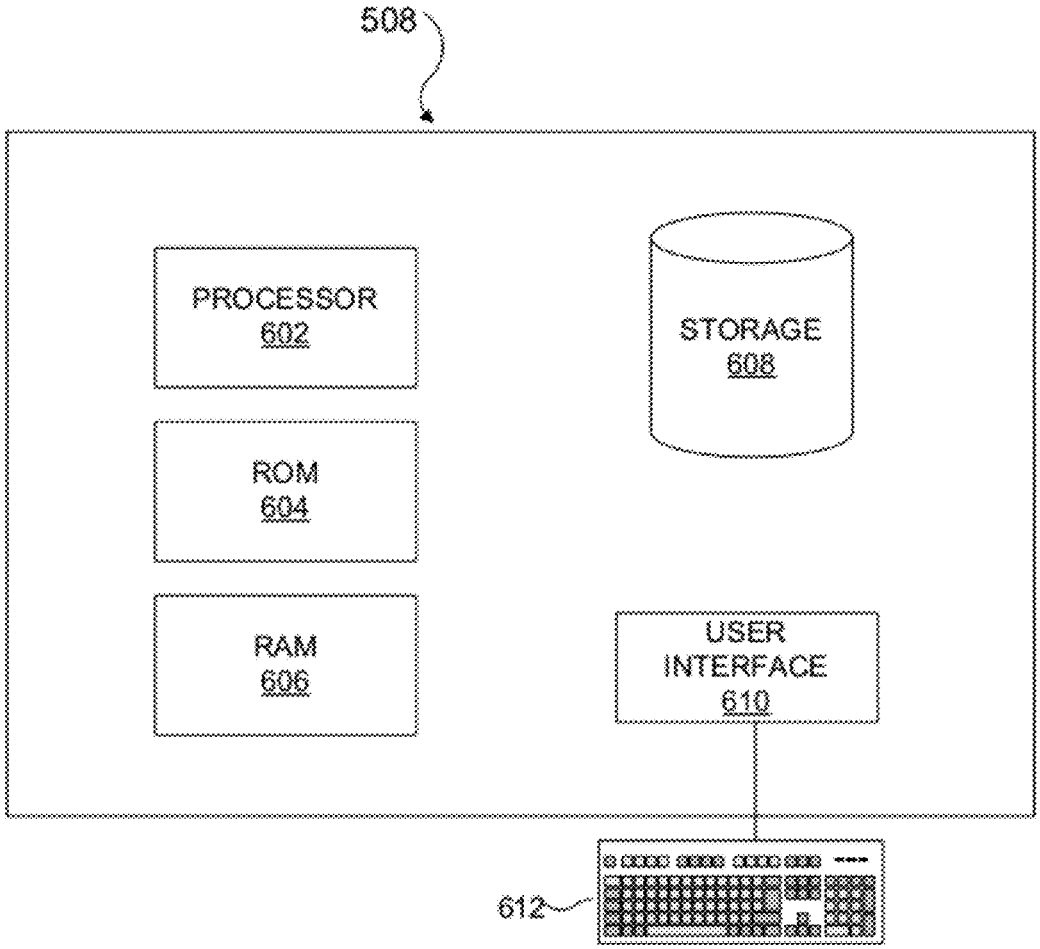
FIG. 6 is a simplified diagram of aspects of the cash recycler and controller of FIG. 5 in accordance with aspects described herein.

With further reference to FIG. 5, the cash recycler 500 or other currency handling device described above may include a controller 508. The cash recycler 500 may include some or all aspects of the cash recycler 200, as shown in FIG. 2. The controller is configured to control the operations of cash recycler 500, including processing transactions including transmitting data to a financial institution for recognition at the financial institution, controlling mechanical systems of the cash recycler 500, controlling access to one or more portions of recycler 500, reconciling logical and physical counts and the like. As shown in FIGS. 5 and 6, the controller 508 may be physically located within the housing of the cash recycler, e.g., as part of a cash recycler housing 501, or as a separate component. The controller 508 generally includes a processor 602. Controller 508 may further include memory such as RAM 606 and ROM 604. In addition, the controller may include or have access to storage 608 and a user interface 610. The user interface 610 may include a display as well as various input devices such as a keyboard 612, mouse, and the like. In some arrangements, the display may be a touch-sensitive display thereby allowing user input to be received through the display. Additionally or alternatively, the user interface may be configured to receive voice commands. The controller may further be configured to control various peripheral devices, such as a printer, external storage device, and the like using one or more adapters and interfaces (not shown).

The controller 508 is configured to execute software for providing functionality to the cash recycler 500. For instance, the controller 508 executes commands as directed by the software to control transactions made using the currency recycler 500, communicate with the financial institution or other entity, provide outputs via the user interface 610 or a peripheral device, such as a printer, and also to physically move the currency within the cash recycler 500.

For example, a user may deposit $1000 into the cash recycler 500. The user provides input through the user interface 610 regarding the deposit. This user input may include selection from a display, voice commands, and the like. The money is then deposited into the cash recycler 500. In one arrangement, the controller 508, in response to various instructions provided by the software, may control the mechanical systems of the cash recycler 500, as well as the electronic (e.g., computer) systems of the cash recycler 500. For instance, the controller 508 may operate the mechanical system that controls the flow of currency into the machine during a deposit. In another arrangement, the controller 508 may house the software configured to send and receive instructions to an additional driver or controller that controls the flow of currency. These mechanical systems are not shown in the figures but are indicated by arrows 503. In addition, the controller 508 controls the scanning device 502 to scan each bill inserted into the cash recycler 500 to confirm authenticity and to verify the condition of the bill. If a bill is deemed to be an unauthorized reproduction it will be removed from circulation and stored in a separate region of the cash recycler 500. The controller 508 will engage various mechanical systems to store the bill in the separate region. If the bill is deemed too worn to be returned to circulation, the mechanical systems run by the controller 508 will remove the bill and place it in a separate region for storage. If the bill is deemed suitable to return to circulation it will remain with the bills in the recycler 500 that may be withdrawn from the recycler 500. Further, controller 508 may reconcile a deposit amount specified by a depositing user and a physical count of the currency actually deposited to insure accuracy and integrity. In addition, the controller 508 will store data related to the amount of currency inserted into the cash recycler 500, as well as the amount of currency removed from circulation for various reasons. In still other examples, the controller 508 may aid in transmitting the cash transaction information to the financial institution. Additionally or alternatively, the controller 508 may forward a communication, such as an email, to an email box reporting the cash transaction. In still other arrangements, the controller 508 may forward a report of the cash transaction to a peripheral device, such as a printer, to print the report as a record of the cash transaction.

In some arrangements, the cash recycler 500 may be a hardened device. That is, the cash recycler 500, along with controller 508, may be constructed in a secure manner such that cash recycler 500 and controller 508 might not be easily reconfigured. For example, a controller such as controller 508 may be integrated into cash recycler 500 using application specific circuits, dedicated hardware connections and components and the like that might not be easily disrupted or reconfigured. This may prevent intruders from gaining unauthorized access into the cash recycler system by, e.g., merely disconnecting an external controller.

Additionally or alternatively, access to the various functions of the cash recycler 500 may be password protected or may require other authorization and authentication before a user may perform or adjust those functions. In one arrangement, biometric data, such as fingerprint, iris scan, and the like, may be used to authenticate a user of the cash recycler 500 to permit adjustment to various settings. In addition, access to the internal portion of the cash recycler 500 may be restricted to only authorized users. The cash recycler 500 may include one or more locks to prevent unauthorized access to the internal portion of the cash recycler 500. Integrating the controller 508 within the cash recycler 500 provides such additional security to prevent unauthorized access to the computer systems and internal portion of the cash recycler 500 and reduces the ability of would-be intruders to access the controller 508 and bypass such security measures.

With further reference to FIG. 5, the cash recycler 500 may include an environmental condition monitoring system 550 arranged within the housing 501 of the cash recycler 500. The environmental condition monitoring system 550 generally includes one or more sensors 552, 554, 556 configured to monitor environmental conditions within the housing 501 of the cash recycler 500. For instance, the environmental condition monitoring system 550 may include a temperature sensor 552 configured to sense the temperature within the housing 501 of the cash recycler 500. Additionally or alternatively, the environmental condition monitoring system 550 may include a humidity sensor 554 configured to monitor the humidity inside the housing of the cash recycler. The monitoring system 550 may also include a sensor 556 configured to monitor the amount of debris in the air within the housing 501 of the cash recycler 500. For instance, the debris monitor 556 may monitor the number of particles, such as dust particles in parts per million or other appropriate units, in the air in the housing 501 of the cash recycler 500. Sensors used in the environmental condition monitoring system 550 may be any known sensor for use in sensing temperature, humidity, and the like.

The environmental condition monitoring system 550 may be in communication with a processor (such as processor 602 in FIG. 6) and/or controller 508 of the cash recycler 500. That is, the sensors 552, 554, 556 of the environmental condition monitoring system 550 may output various readings or indications to the processor 602 and/or controller 508 of the cash recycler 500 in order to adjust operation of the cash recycler 500 based on the indications or readings provided by the sensors 552, 554, as will be discussed more fully below.

Figure 7:
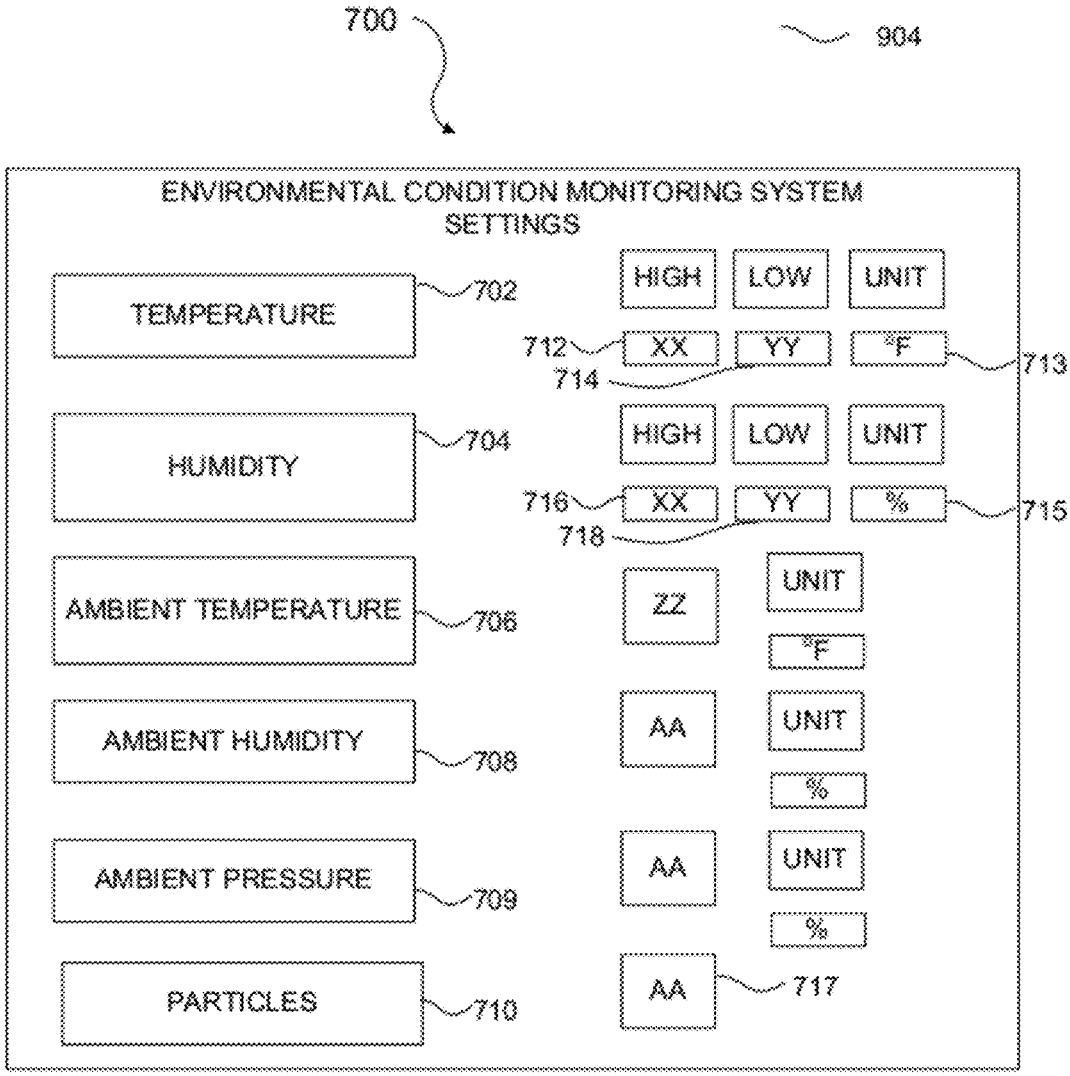
FIG. 7 is an example user interface for configuring various aspects and functions of the environmental condition monitoring system in accordance with aspects described herein.

The indications provided by the sensors 552, 554, 556 of the environmental condition monitoring system 550 may be used to adjust operation of the cash recycler 500 in order to optimize performance of the cash recycler 500, as well as improving operation to reduce or prevent instances of malfunction, such as paper jams, service calls, and the like. In some arrangements, the system may develop and/or optimize a preventative maintenance schedule based on the monitored environmental conditions. For instance, the system may build and use an algorithm to optimize preventative maintenance based on the monitored environmental conditions. The resulting algorithm may be monitored from a central location, such as a central server, and alerts may be sent automatically to a third party maintenance provider. The maintenance provider may then schedule maintenance with the client and dispatch service technicians accordingly. Additionally or alternatively, on screen alerts may be provided to the client indicating that maintenance may be performed based on usage patterns, environmental factors, bill quality, and the like. For instance, various environmental condition levels or thresholds may be predetermined by the user and indications outside those levels may lead to adjustment of operation of the cash recycler 500. For instance, FIG. 7 illustrates one example user interface 700 in which various environmental condition monitor settings may be entered or specified. For instance, thresholds or settings for various levels, such as temperature, humidity and the like shown in fields 702-710, may be predetermined and input by the user. As shown in fields 712, 714, high and/or low temperatures may be preconfigured by a user. The temperature input in these fields 712, 714 by the user is generally the threshold at which a notification of the temperature being outside the predetermined threshold will be sent to the controller and the controller 508 will adjust the operation of the cash recycler 500 based on the temperature indication. Field 713 permits a user to input the units in which temperature will be measured, e.g., degrees Fahrenheit or Celsius.

Fields 716 and 718 of FIG. 7 are example regions where a user may input a high and low humidity threshold. These threshold levels are generally the point at which a notification will be sent to the controller 508 that the conditions within the housing 501 of the cash recycler 500 are outside of normal operating conditions and the controller 508 will adjust operation of the cash recycler 500 to accommodate the abnormal humidity conditions. Field 715 permits a user to input the units in which humidity levels will be input, e.g., percentage. In some arrangements, severe or extreme environmental conditions may prompt alerts to be sent to the financial institution.

In addition to permitting a user to input threshold levels at which the controller 508 may adjust operation of the cash recycler 500, the user interface 700 permits a user to input the ambient conditions of the cash recycler in order to optimize performance of the cash recycler 500 based on its location. For instance, ambient temperature, pressure, and humidity may be input in fields 706, 708 and 709 to establish a base line operating point for the cash recycler 500. These ambient conditions may change depending on geographic location of the cash recycler 500. In order to optimize performance of the cash recycler 500, these ambient conditions may be input by the user or may be sensed by an ambient condition monitoring system (such as 580 in FIG. 5) to establish a normal or baseline operating point for the cash recycler 500 based on location. That is, the speed of the rollers, gap height of feeding mechanisms, quality of the bills that will be accepted, and the like will be based on, among other factors, these ambient conditions.

Additionally or alternatively, the threshold humidity and temperature levels at which operation of the cash recycler will be adjusted may be based on a percentage of these ambient conditions. That is, once the ambient conditions are input, a user may select percentages of ambient at which the operation should be adjusted. For example, a user may select a 5% threshold. In this arrangement, any indication from the temperature or humidity sensor more than the predetermined 5% from the ambient set point will trigger transmission of an indication that the levels are outside the normal operating condition and the controller may automatically adjust operation of the cash recycler 500. The 5% value cited is merely an example and should not be seen to limit the value at which the percentages may be set. Rather, any reasonable percentage may be used.

In addition, user interface 700 includes region 717 in which a user may specify a threshold number of particles (e.g., in parts per million) that may be present within the housing 501 of the cash recycler 500 before an indication of high particles is transmitted and the operation of the cash recycler 500 is adjusted. For instance, debris, dust, and other particles may jam the cash recycler 500 or slow its operation. The user may determine a permissible level of debris that can exist within the housing 501 while normal operation of the cash recycler 500 is maintained. If the debris level goes beyond that threshold, operation of the cash recycler 500 may be adjusted (e.g., rollers slowed, and the like) or stopped in order to clean the cash recycler 500 prior to any malfunction of the cash recycler 500.

Selection of the appropriate value or option in the user interface described above may be done using known methods of selection including clicking or double clicking in the region and inputting a value, selecting a value from a drop-down menu, selecting a radio button associated with the desired value, and the like.

Figure 8:
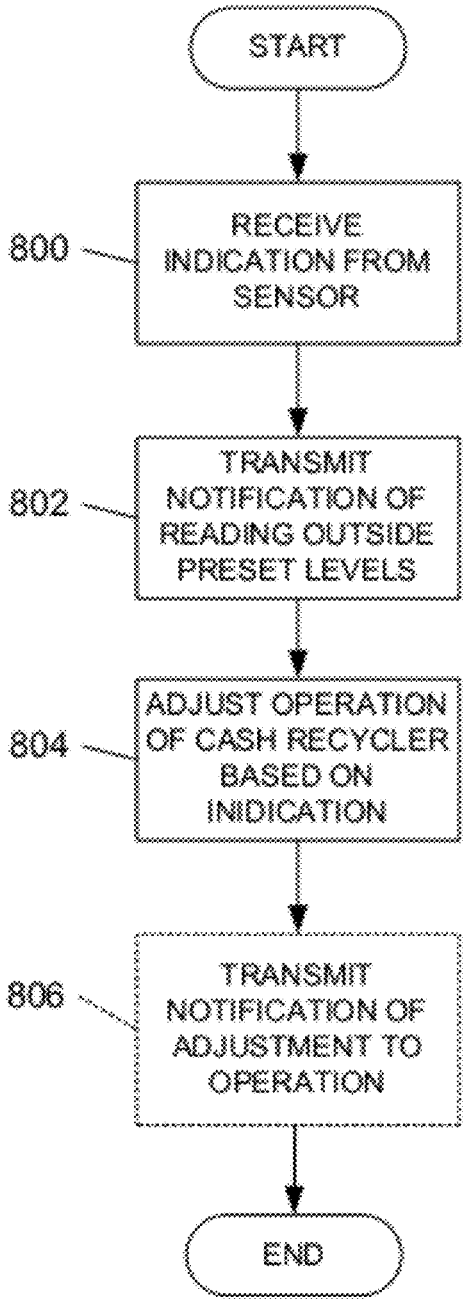
FIG. 8 illustrates a method for adjusting operation of the cash recycler based on environmental conditions in accordance with aspects described herein.

FIG. 8 illustrates one example method of adjusting operation of the cash recycler based on indications received from the environmental condition monitoring system. In step 800, an indication may be received from one or more of the sensors, i.e., temperature, humidity, and the like. The indication received, and/or the actual level, may be communicated to the controller of the cash recycler 500 in step 802. In addition, a notification of a reading outside the predetermined threshold may optionally also be transmitted to a financial institution, manager of the retail store at which the cash recycler is located, and the like.

In response to receiving the notification that the level is outside the predetermined threshold, the controller may adjust operation of the cash recycler in step 804 to accommodate the level of the environmental condition outside the threshold, i.e., high temperature, high humidity, and the like and the effect of the level on the currency within the recycler. For example, in the case of a high humidity indication, high humidity may cause the bills to increase in volume due to increased moisture. This increased volume may cause additional paper jams within the recycler, or other malfunctions. Accordingly, in order to reduce the occurrence of or prevent these additional service issues, adjustments may be made to the operation of the cash recycler. For instance, upon receiving an indication that the humidity is higher than the predetermined high threshold, the controller may slow operation of the cash recycler. For example, the rollers used to transport currency within the cash recycler may be slowed in order to prevent jams or other malfunctions due to currency having an increased volume due to high humidity.

In instances of low humidity, the system may be sped up to take advantage of the favorable conditions for processing currency. Additionally or alternatively, the gap height of feeding mechanisms may be adjusted in response to environmental conditions and/or bill quality. For instance, poor quality notes processed in humid conditions may prompt an automatic increase in the gap height of feeding mechanisms. In still other arrangements, the tension on rollers and/or belts may be adjusted (i.e., increased or decreased) based on the determined low humidity condition.

In addition to adjusting operation of the cash recycler 500 in response to the high humidity reading, the controller may also activate another component of the cash recycler 500 to aid in reducing humidity. For instance, the controller may activate a fan or dehumidifier arranged within the cash recycler 500 to aid in reducing humidity.

In another example, a high temperature indication may also cause the controller to slow operation of the cash recycler in order to prevent overheating of the mechanical equipment controlling the cash recycler and to better handle the cash within the cash recycler. In addition, the high temperature reading may cause the controller to activate a fan, air conditioning unit, and the like arranged within the cash recycler 500 to aid in reducing the temperature within the housing 501 of the cash recycler 500.

In optional step 806, notification of any adjustments made to the operation of the cash recycler may be transmitted to the financial institution, a central server at the retail store using the cash recycler, a manager of the retail store using the cash recycler, and the like.

Figure 9:
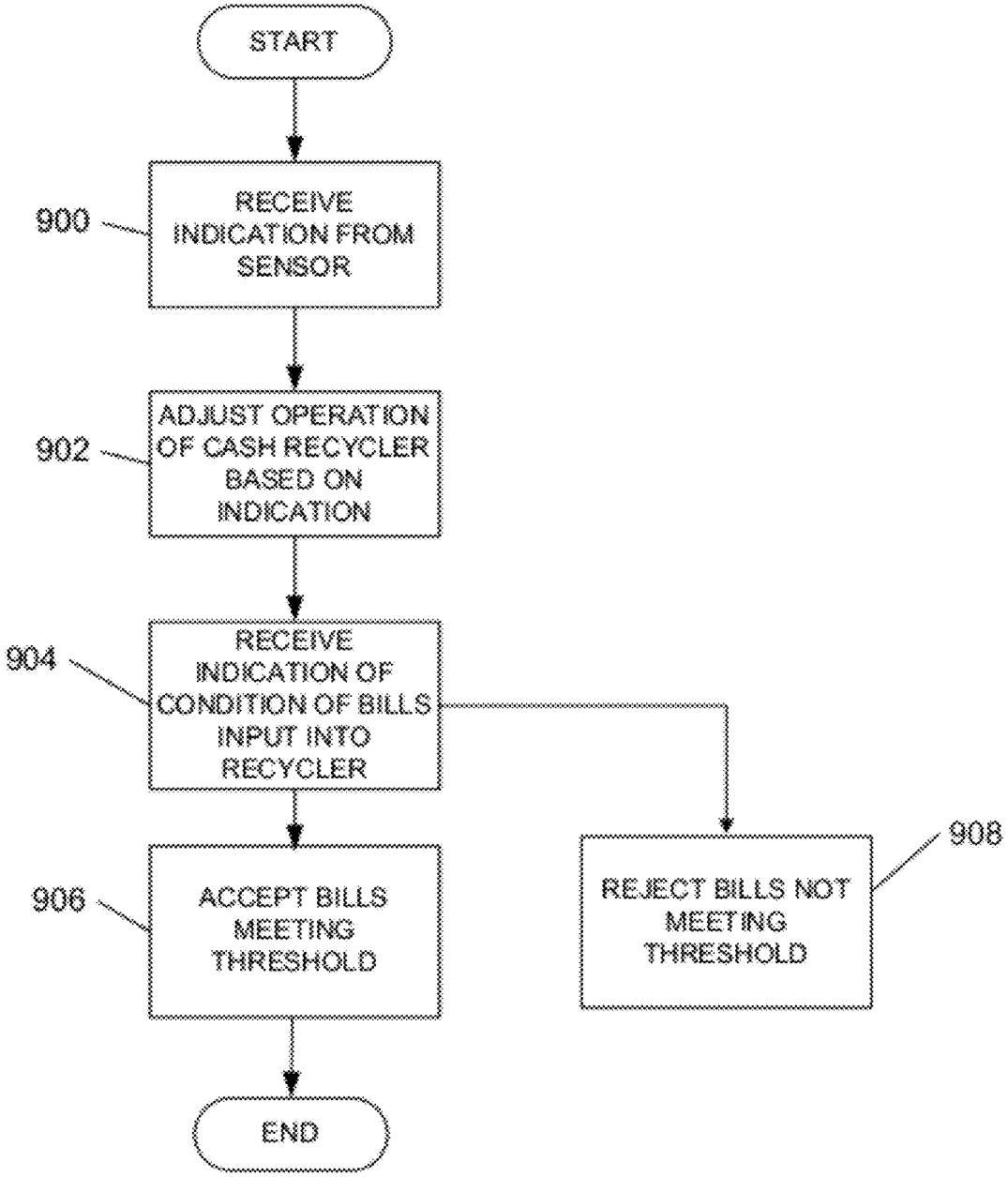
FIG. 9 illustrates another method for adjusting operation of the cash recycler based on environmental conditions in accordance with aspects described herein.
Figure 10:
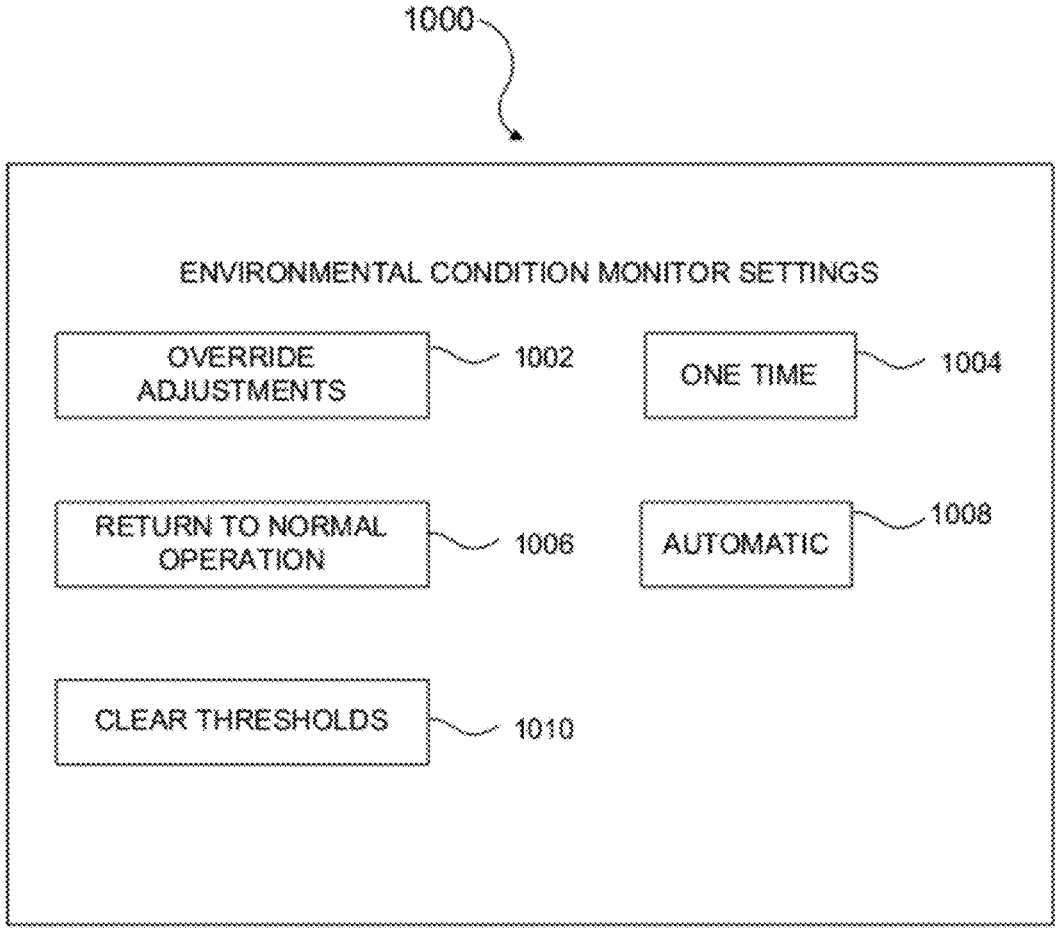
FIG. 10 is an example user interface for configuring additional aspects and functions of the environmental condition monitoring system in accordance with aspects described herein.

FIG. 9 illustrates another example method of adjusting operation of the cash recycler based on indications from the environmental condition monitoring system. In the method described, the cash recycler may adjust the fitness of bills that will be accepted by the cash recycler based on indications received from the environmental condition monitoring system. For example, in step 900, an indication is received from a sensor, i.e., temperature, humidity, and the like that a level is outside the predetermined threshold level. In step 902, the indication and/or the level is transmitted to the controller and the operation of the cash recycler is adjusted based on the level transmitted. In this example, adjustment of operation of the cash recycler includes adjusting the threshold for bills fit to be accepted by the cash recycler. That is, bills of lesser quality, e.g., bills that are excessively wrinkled, torn, folded, and the like, may be rejected by the cash recycler upon insertion into the cash recycler because of the environmental condition level outside the predetermined threshold. Alternately, bills of lesser quality may be accepted, but stored within a non-recycling cassette to prevent future problems. For example, if a high humidity indication is received, the cash recycler will be adjusted to accept bills of a higher quality because lesser quality bills, such as those that are torn, excessively wrinkled, and the like will take up additional space due to the increased humidity and are more likely to cause a jam or other malfunction due to the higher humidity.

In step 904, bills or other paper currency are inserted into the cash recycler and the condition of the bills is evaluated by a bill validation unit. For instance, the condition of the bills may be evaluated using known methods of evaluating bills, such as a "sonic bounce" off the note to determine how worn the note is. If the bills meet the higher threshold established when operation of the cash recycler was adjusted, the bills will be accepted, as in step 906, and will remain in circulation within the cash recycler. If the bills do not meet the threshold for acceptance, the bills will be rejected, as in step 908. For example, rejection of the bill may include the bill being outright rejected by the intake slot on the cash recycler and returned to the customer. In some arrangements, the bill will be accepted into the cash recycler but may be transferred to a storage unit, e.g., cartridge, in which bills will not be circulated throughout the cash recycler but will instead be stored until removed from the cash recycler by a transport carrier for deposit at a financial institution. Additionally, machine settings including but not limited to processing speed, gap height of feeding mechanisms, or tension on rollers and/or belts may be adjusted (i.e., increased or decreased) in response to a determination of note quality at a location. These adjustments may be made automatically based on the average note quality for the location. For instance, individual note quality may be assessed on a scale of 0 to 4 with 4 being the highest. If average note quality for a location falls below a predetermined threshold, such as 2, processing speed may be slowed from one setting to another, such as from 8 notes per second to 5 notes per second, to ensure better handling of the low quality currency.

In order to return the cash recycler to normal operation, i.e., operation according to environmental conditions within the predetermined threshold levels or default settings, a user may manually return the cash recycler to operation via the user interface. For example, a user interface 1000 generally includes an override option 1002 for a user to override the changes implemented by the controller based on the indications from the environmental condition monitoring system. This override option 1002 may simply override the changes to operation for a single transaction, as indicated in field 1004, or may override the changes for all transactions. In addition, the user interface 1000 includes options for reverting back to normal operation of the cash recycler in field 1006. The reversion may be manual, i.e., a user may, via the user interface, override the changes made to the operation of the cash recycler, or automatic, as shown in field 1008. For instance, the cash recycler may include an automatic reversion option wherein an indication that the levels have returned to within the predetermined threshold will be transmitted to the controller and the controller will adjust operation of the cash recycler back to its normal or baseline operation. In addition, user interface 1000 includes an option 1010 to clear all thresholds. This option will then permit a user to input new thresholds.

Although not required, one of ordinary skill in the art will appreciate that various aspects described herein may be embodied as a method, a data processing system, or as one or more computer-readable media storing computer-executable instructions. Accordingly, those aspects may take the form of an entirely hardware embodiment, an entirely software embodiment or an embodiment combining software and hardware aspects. In addition, various signals representing data or events as described herein may be transferred between a source and a destination in the form of light and/or electromagnetic waves traveling through signal-conducting media such as metal wires, optical fibers, and/or wireless transmission media (e.g., air and/or space).

Aspects of the invention have been described in terms of illustrative embodiments thereof. Numerous other embodiments, modifications and variations within the scope and spirit of the appended claims will occur to persons of ordinary skill in the art from a review of this disclosure. For example, one of ordinary skill in the art will appreciate that the steps illustrated in the illustrative figures may be performed in other than the recited order, and that one or more steps illustrated may be optional in accordance with aspects of the disclosure.

What is claimed is:

1. A cash handling device, comprising:

a debris sensor arranged within a housing of the cash handling device and configured to monitor a level of dust within the cash handling device; and a controller configured to adjust operation of the cash handling device based on the monitored level of dust, wherein the controller is configured to adjust an operating speed of the cash handling device based on the monitored dust level.

2. The cash handling device of claim 1, further including an environmental condition monitoring system configured to monitor at least one of a temperature and a humidity within the housing of the cash handling device and at least one of an ambient temperature and an ambient humidity outside the housing of the cash handling device.

3. The cash handing device of claim 1, further including an environmental condition monitoring system configured to:

create an optimized preventative maintenance schedule based on at least one monitored environmental condition; and transmit an alert based on the optimized preventive maintenance schedule.

4. The cash handling device of claim 1, further including at least a second sensor arranged within the housing of the cash handling device, wherein the second sensor is selected from a group comprising:

a temperature sensor configured to sense a temperature within the housing; and a humidity sensor configured to sense a humidity within the housing.

5. A method of controlling operation of a cash handling device, comprising:

receiving, by a controller, an indication of a level of dust within a housing of the cash handling device; and responsive to receiving the indication of the level of dust within the housing, adjusting, by the controller, operation of the cash handling device based on the indication of the level of dust within the housing, wherein the adjusting of the operation of the cash handling device includes adjusting an operation speed of the cash handling device.

6. The method of claim 5, further including transmitting a notification of the level of dust within the housing to at least one of a financial institution, central server of a retail store, and retail store manager.

7. One or more computer-readable media storing computer readable instructions that, when executed by a processor, cause the processor to:

receive an indication of a level of dust within a housing of a cash recycler device; and responsive to receiving the indication of the level of dust within the housing, adjust operation of the cash recycler device based on the indication of the level of dust within the housing, wherein the instructions, when executed by the processor, cause the processor to, responsive to receiving the indication of the level of dust within the housing, adjust an operation speed of the cash handling device based on the indication of the level of dust within the housing.

8. The one or more computer-readable media of claim 7, wherein the instructions, when executed by the processor, further cause the processor to:

transmit a notification of the level of dust within the housing to at least one of a financial institution, central server of a retail store, and retail store manager.

9. The one or more computer-readable media of claim 7, wherein the instructions, when executed by the processor, further cause the processor to:

create a preventative maintenance schedule based on at least one monitored environmental condition; and transmit an alert based on the preventive maintenance schedule.

10. A method of controlling operation of a cash handling device, comprising:

receiving an indication of a note quality of a note at a location within the cash handling device;

receiving an indication of an environmental condition;

determining a note quality threshold based on the environmental condition;

determining that the note quality is below the determined note quality threshold;

responsive to determining that the note quality is below the determined note quality threshold, adjusting, by a controller, operation of the cash handling device based on the received indication of the environmental condition;

responsive to the determining that the note quality is below the determined note quality threshold, adjusting, by the controller, the operation of the cash handling device by moving said note to a location outside of the cash handling device;

responsive to determining that the note quality is above a second note quality threshold, adjusting, by the controller, operation of the cash handling device by moving the note to a first storage location within the cash handling device; and responsive to determining that the note quality is between the determined note quality threshold and the second threshold, adjusting, by the controller, operation of the cash handling device by moving the note to a second storage location within the cash handling device.

11. The method of claim 10, wherein the adjusting of the operation of the cash handling device includes adjusting at least one of: processing speed, gap height of a feeding mechanism, tension on a roller, and tension on a belt.

12. The method of claim 10, wherein the note quality is an average note quality at a geographic location of the cash handling device.

13. The method of claim 10, wherein the adjusting of the operation of the cash handling device is performed automatically upon determining that an average note quality at a geographic location of the cash handling device is below the determined threshold level.

14. The method of claim 10, further including automatically returning the cash handling device to a normal operation upon receiving an indication that an average note quality at a geographic location of the cash handling device is above the determined threshold.

15. The one or more computer-readable media of claim 10, wherein the determining of the threshold based on the environmental condition includes autonomously adjusting the threshold based on changes in the indication of the environmental condition.

16. The method in claim 10, wherein the environmental condition includes at least one of:

temperature within a housing of the cash handling device, humidity within the housing of the cash handling device, and dust level within the housing of the cash handling device.

17. The method of claim 10, wherein the cash handling device is configured to recirculate the note stored in the first storage location, and configured to not recirculate the note stored in the second storage location.

* * * * *